US010244863B2

(12) United States Patent
Grappe

(10) Patent No.: US 10,244,863 B2
(45) Date of Patent: Apr. 2, 2019

(54) ADJUSTABLE SHELF

(71) Applicant: James Daniel Grappe, Austin, TX (US)

(72) Inventor: James Daniel Grappe, Austin, TX (US)

( * ) Notice: Subject to any disclaimer, the term of this patent is extended or adjusted under 35 U.S.C. 154(b) by 8 days.

(21) Appl. No.: 15/707,225

(22) Filed: Sep. 18, 2017

(65) Prior Publication Data

US 2018/0078035 A1 Mar. 22, 2018

Related U.S. Application Data

(60) Provisional application No. 62/396,665, filed on Sep. 19, 2016.

(51) Int. Cl.

| | |
|---|---|
| ***A47B 43/00*** | (2006.01) |
| ***A47B 96/02*** | (2006.01) |
| ***A47B 57/10*** | (2006.01) |
| ***A47B 45/00*** | (2006.01) |

(52) U.S. Cl.

CPC ..... *A47B 43/00* (2013.01); *A47B 45/00* (2013.01); *A47B 57/10* (2013.01); *A47B 96/021* (2013.01); *A47B 2220/0072* (2013.01)

(58) Field of Classification Search

CPC ..... A47B 45/00; A47B 96/025; A47B 57/10; A47B 57/26; A47B 43/00; A47B 43/02; A47B 96/02; A47B 96/021

See application file for complete search history.

(56) References Cited

U.S. PATENT DOCUMENTS

| | | | | | |
|---|---|---|---|---|---|
| 2,067,661 | A * | 1/1937 | Ferrelle | B60N 3/004 | 108/152 |
| 2,249,234 | A * | 7/1941 | Srodulski | G07F 9/10 | 211/149 |
| 2,599,504 | A * | 6/1952 | Wise | A47B 67/04 | 312/293.2 |
| 3,360,321 | A * | 12/1967 | Novales | A47B 47/03 | 211/153 |
| 3,424,283 | A * | 1/1969 | Sheldon | A45C 9/00 | 190/11 |
| 4,500,146 | A * | 2/1985 | Peterson | A47B 45/00 | 108/102 |
| 5,137,160 | A * | 8/1992 | Santucci | A47B 45/00 | 211/153 |

(Continued)

FOREIGN PATENT DOCUMENTS

| | | | | |
|---|---|---|---|---|
| DE | 9411381 U1 * | 12/1994 | ..... | A47B 43/00 |
| DE | 19517550 A1 * | 11/1996 | ..... | A47B 43/00 |

(Continued)

*Primary Examiner* — Kimberley S Wright

(74) *Attorney, Agent, or Firm* — Kelly Kordzik; Matheson Keys & Kordzik PLLC

(57) ABSTRACT

A storage apparatus with a shelf having first and second planar members hingeably coupled to each other by a hinge mechanism, and first and second walls spaced apart from each other, wherein each of the first and second walls have a means for holding the shelf at a location between the first and second walls, wherein the shelf is configured so that the first and second planar members are pivotable at angles relative to each other about the hinge mechanism for insertion into and removing from the location between the first and second walls.

20 Claims, 7 Drawing Sheets

(56) References Cited

U.S. PATENT DOCUMENTS 5,138,956 A * 8/1992 Rushbrook ..... A47B 57/06 108/107
5,183,166 A 2/1993 Belokin, Jr. et al.
5,415,472 A * 5/1995 Brise ..... A47B 45/00 211/153
5,421,646 A * 6/1995 McNamara ..... A47B 45/00 108/102
5,927,519 A * 7/1999 Koonts ..... A47B 81/00 211/104
6,450,599 B1 * 9/2002 Mamuyac ..... A47B 46/005 312/258
6,561,107 B1 * 5/2003 Wood ..... A47B 3/0812 108/132
6,561,601 B1 * 5/2003 Maffeo ..... A47B 47/0075 312/257.1
6,848,371 B2 2/2005 Zheng
6,877,826 B2 * 4/2005 Wood ..... A47B 45/00 108/110
7,007,614 B2 * 3/2006 Gaunt ..... A47B 45/00 108/102
7,100,882 B2 * 9/2006 Behroozi ..... A47B 23/04 248/317
7,389,887 B2 6/2008 Liang
7,416,162 B2 * 8/2008 Behroozi ..... A47B 23/04 248/317
7,464,827 B2 * 12/2008 Meissen ..... B65D 21/0212 206/557
7,938,496 B1 5/2011 Cattanach
8,256,630 B2 9/2012 Zhu et al.
8,468,956 B2 * 6/2013 Parizek ..... A47B 3/12 108/157.16
9,060,601 B2 6/2015 Landry et al.
9,072,374 B2 * 7/2015 Dange ..... F24C 15/34
9,474,367 B2 10/2016 Frankel et al.
2003/0226815 A1 * 12/2003 Gaunt ..... A47B 45/00 211/153
2004/0164655 A1 * 8/2004 Wood ..... A47B 45/00 312/205
2007/0051284 A1 * 3/2007 Shapiro ..... A47B 43/00 108/59
2008/0308515 A1 * 12/2008 Lange ..... A47B 45/00 211/134
2010/0236457 A1 * 9/2010 Parizek ..... A47B 3/12 108/64
2014/0048500 A1 * 2/2014 Brookes ..... A47B 57/10 211/74
2014/0238383 A1 * 8/2014 Armstrong ..... F24C 15/16 126/337 A
2016/0037913 A1 * 2/2016 Franck ..... A47B 57/20 211/208
2016/0187054 A1 * 6/2016 Park ..... F25D 25/027 312/408
2016/0331128 A1 * 11/2016 Chuang ..... A47B 43/00

FOREIGN PATENT DOCUMENTS

EP 0469612 A1 * 2/1992 ..... A47B 43/00
GB 1043938 A * 9/1966 ..... A47B 43/00

* cited by examiner

ADJUSTABLE SHELF

This application claims the benefit of U.S. provisional patent application Ser. No. 62/396,665, which is hereby incorporated by reference herein.

TECHNICAL FIELD

The present invention relates in general to shelves for storing items thereon, and in particular, to an adjustable shelf.

BACKGROUND INFORMATION

Removable and adjustable shelves are utilized in many different applications to enable a user to position one or more shelves within a storage apparatus (for example, cabinets, storage containers, storage boxes, etc.) in a desired manner depending upon the sizes (e.g., heights) of items to be placed on the one or more shelves. A typical configuration for such adjustable shelving consists of a storage apparatus having pairs of holes formed (e.g., drilled) in two columns on each of the inner sides of the storage apparatus for positioning pins in the holes onto which a shelf is placed at the desired location within the storage apparatus. A problem with such a configuration is that it can be difficult to move a particular shelf from one height to another inside the storage apparatus because of the solid nature of the shelf, which often requires the user to reposition the shelf by manually pivoting it at significant angles relative to horizontal in order to move the shelf from one height to another. This can be exasperated by the existence of a door to the storage apparatus, its hinges, and structural members on the front of the storage apparatus for mounting the door thereon. Additionally, because the shelf has to be inserted at such a significant angle relative to horizontal, it often cannot be positioned at certain locations near the top of the storage apparatus.

DETAILED DESCRIPTION

Embodiments of the present disclosure provide an adjustable shelf that is foldable for easier removal and insertion at various locations within a storage apparatus.

Figure 1A:
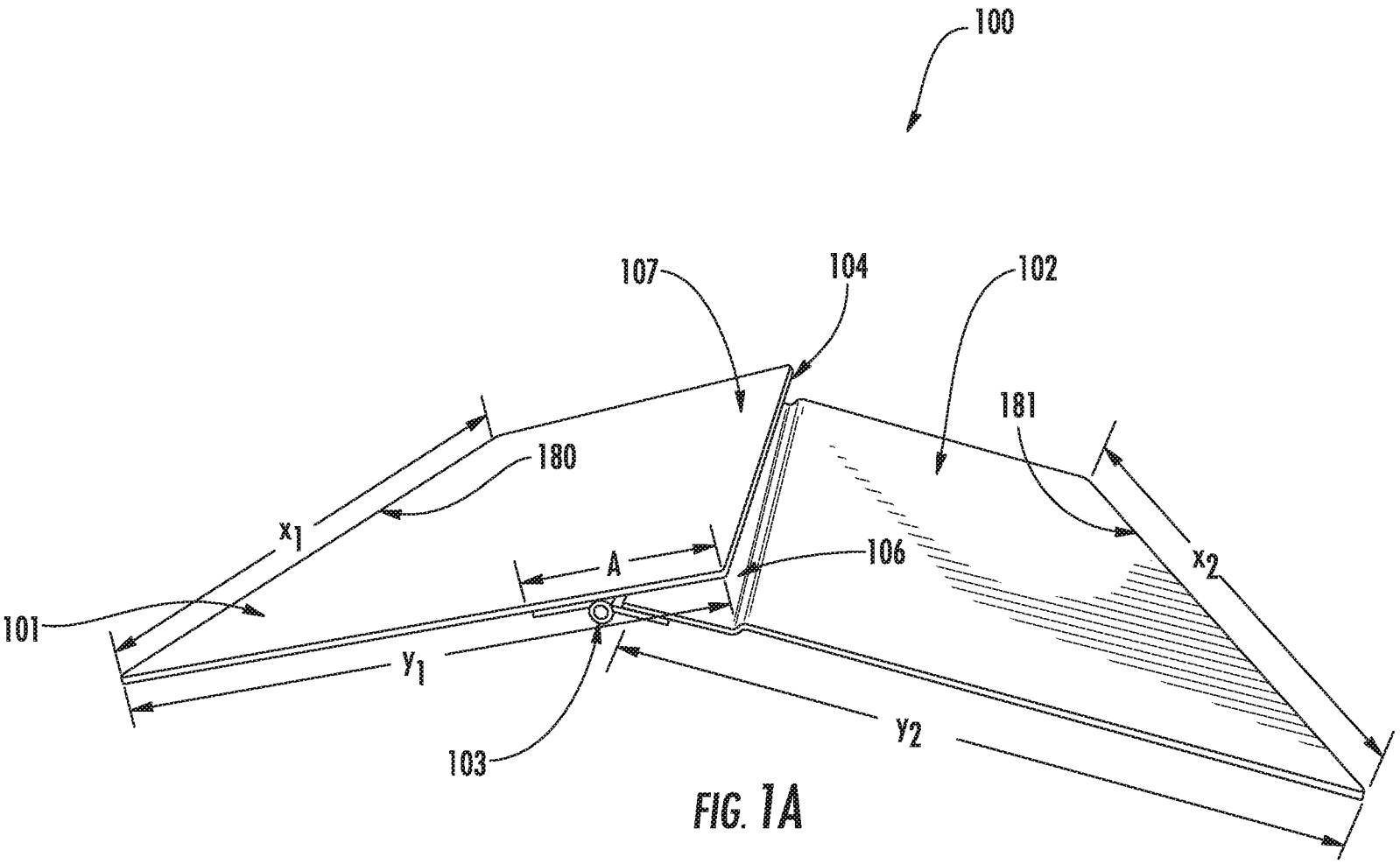
FIGS. 1A-1B illustrate isometric views of a shelf configured in accordance with embodiments of the present disclosure.
Figure 1B:
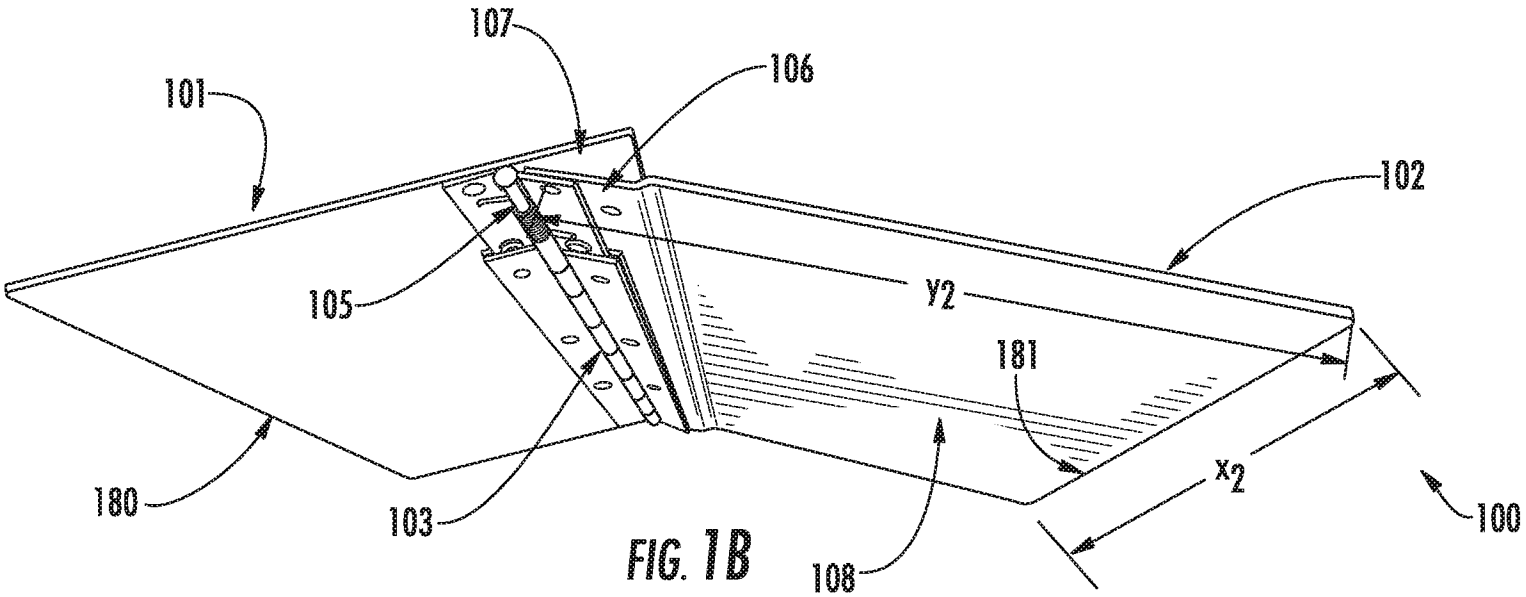

Referring to FIGS. 1A-1B, there are illustrated isometric views of a shelf 100 configured in accordance with embodiments of the present disclosure. FIG. 1A illustrates the shelf 100 in a partially folded configuration, which may be utilized by a user for inserting, removing, and/or repositioning the shelf 100 in a storage apparatus (e.g., see FIGS. 3 and

4A). The shelf 100 has a first planar member 101 having $x_1$ and $y_1$ dimensions and a second planar member 102 having $x_2$ and $y_2$ dimensions, wherein the first and second planar members 101, 102 are hingeably coupled to each other by a hinge mechanism 103, which enables the first and second planar members 101, 102 to pivot at angles relative to each other. The $y_1$ dimension of the first planar member 101 does not necessarily have to be equal to the $y_2$ dimension of the second planar member 102.

The hinge mechanism 103 may be adjoined, or attached, to an underside of the first planar member 101 at a distance A away from the center edge 104 of the first planar member 101. The reason for this will become apparent in the discussion of the shelf 100 with respect to FIG. 4A below. The hinge mechanism 103 may be adjoined, or attached, to the undersides of the first and second planar members 101, 103 using any well-known means, including the use of weld joints, rivets, and/or nuts and bolts. Regardless, such a connection should be sufficient to support the weight of objects intended to be placed on the shelf 100 during use.

The components of the shelf 100 may be made out of any appropriate materials, with the first and second planar members 101, 102 composed of such rigid materials as plastic, wood, metal, etc. The hinge mechanism 103 may also be made from any appropriate material, such as plastic, metal, etc.

Figure 4A:
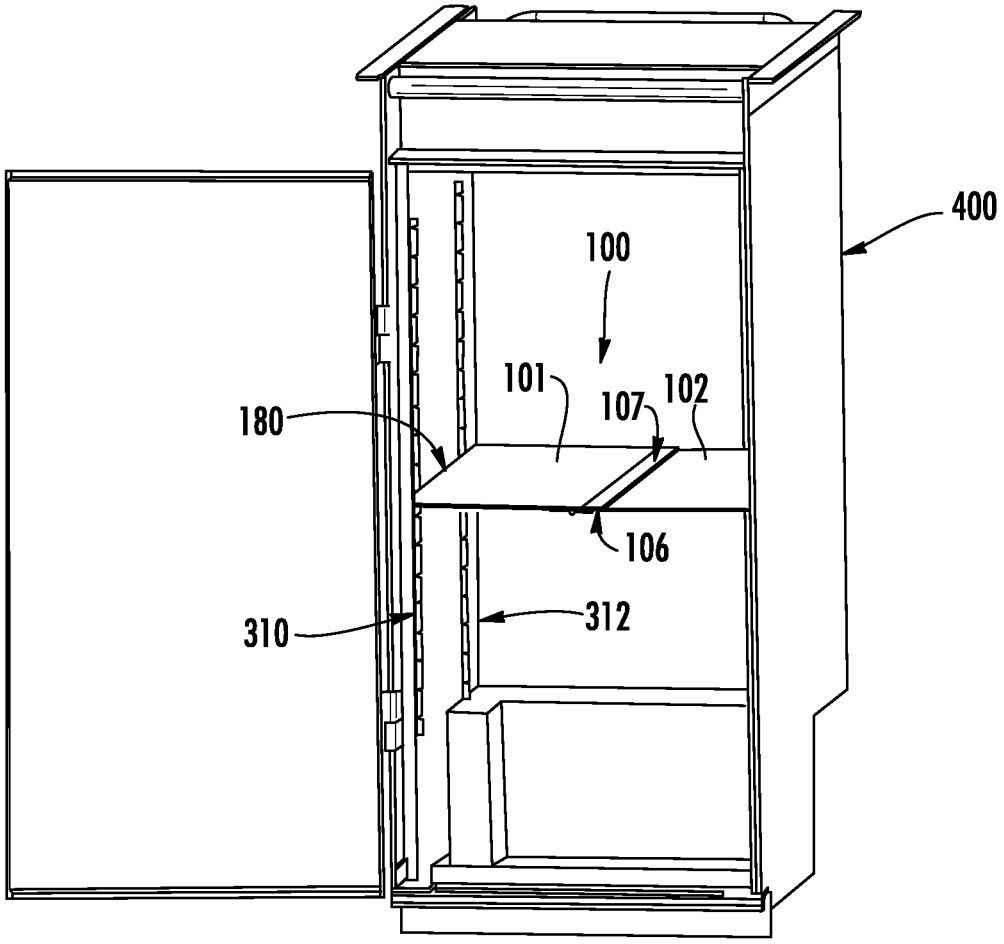
FIG. 4A illustrates a shelf in a usable configuration whereby the first and second planar members are substantially planar to each other.

Referring to FIG. 1B, there is illustrated an underside of the shelf 100 illustrated in FIG. 1A. A spring 105 may be included within embodiments of the shelf 100, which has a sufficient spring tension to force/maintain the first and second planar members 101, 102 on the same plane with each other (e.g., substantially coplanar with each other, such as shown in FIG. 4A). Though not limited to the configuration illustrated in FIG. 1B, the spring 105 may be wound around a portion of the pin utilized within the hinge mechanism 103 in the well-known configuration shown in FIG. 1B. Implementation of the spring 105 is optional within embodiments of the present disclosure.

FIG. 4A illustrates an isometric view of the shelf 100 of FIG. 1A showing an exemplary configuration of the shelf 100 as it would be used within an exemplary storage apparatus 400. As can be seen in this illustration, a portion 106 of the second planar member 102 supports (e.g., in a physical engagement) a portion 107 of the first planar member 101 in a manner so that top surfaces of the two planar members 101, 102 are substantially planar with each other (i.e., substantially coplanar) to provide a substantially planar top surface for supporting items.

Referring again to FIGS. 1A-1B, within embodiments of the present disclosure, the portion 106 of the second planar member 102 that supports the portion 107 of the first planar member 101 may be positioned at a slightly different but parallel plane as the remainder of the first planar member 101 so that the overall top surface of the shelf 100 is substantially planar throughout. This may be accomplished by the portion 106 of the second planar member 102 being a separate piece of material that is attached (e.g., welded, riveted, etc.) to an underside of the remainder 108 of the second planar member 102. Alternatively, the second planar member 102 may be formed so that a top surface of the portion 106 of the second planar member 102 is positioned parallel but not coplanar with a remaining top surface 108 of the second planar member 102.

Figure 2A:
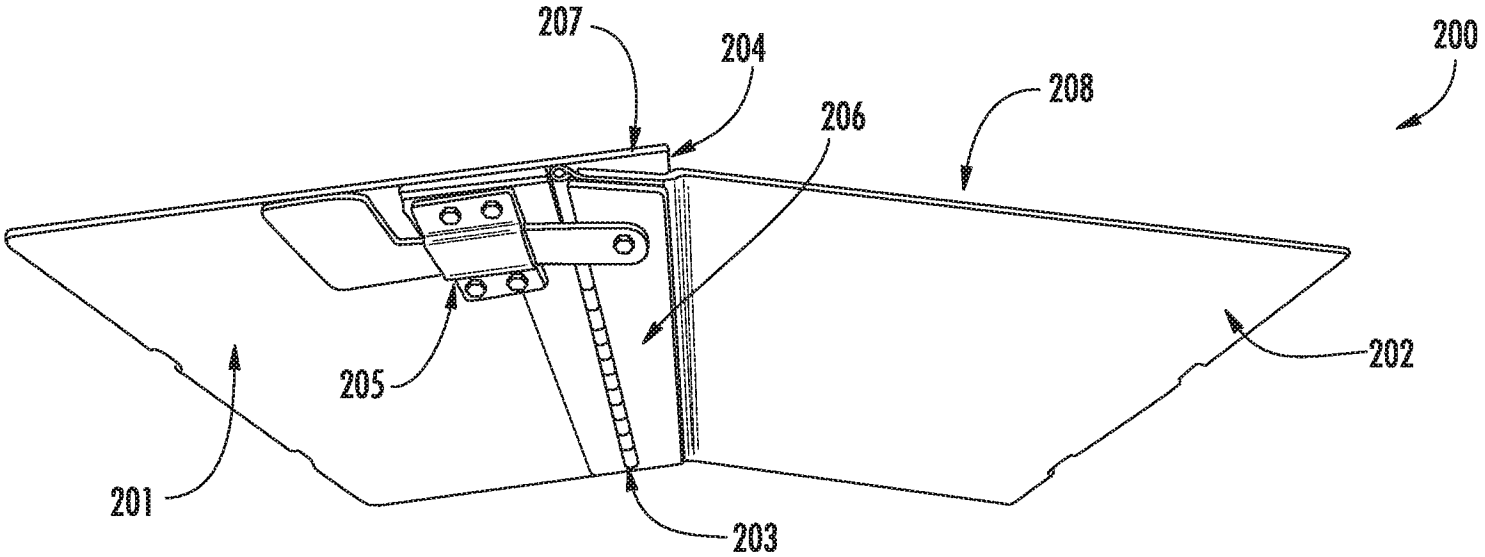
FIGS. 2A-2B illustrate isometric views of a shelf configured in accordance with embodiments of the present disclosure, which includes a moveable latch.
Figure 2B:
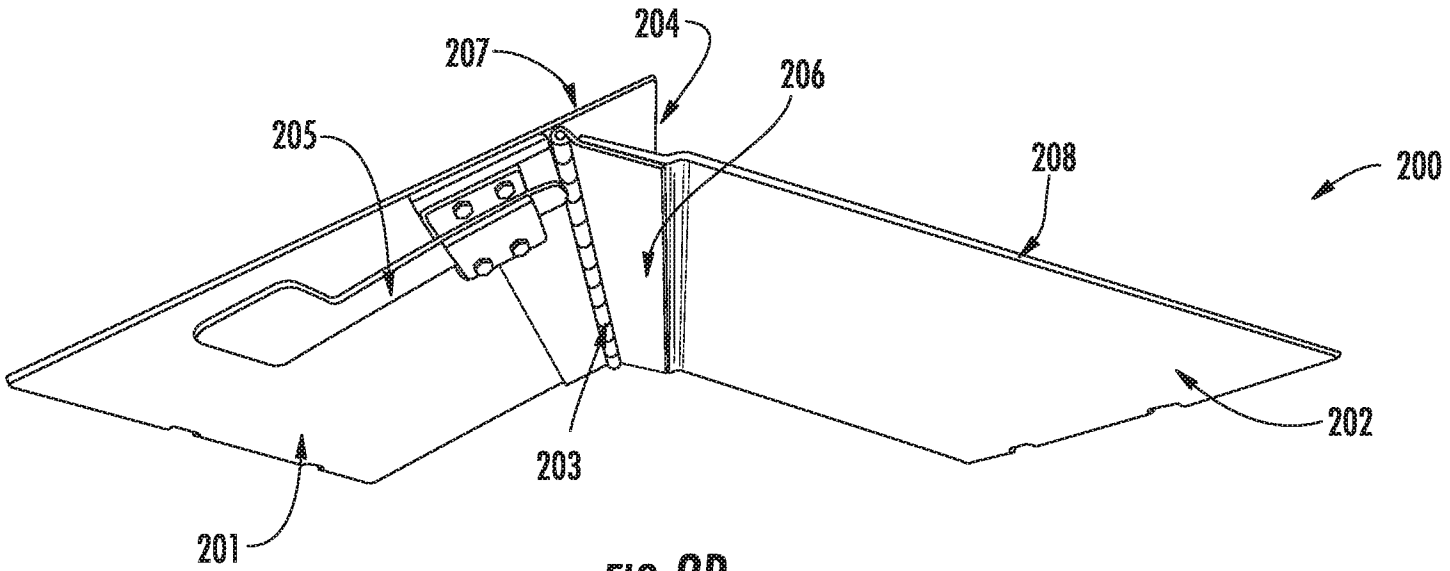

FIGS. 2A-2B further illustrate embodiments of the present disclosure providing a shelf 200 that includes a moveable latch 205 for locking the first and second planar members 201, 202 in a rigid relationship to each other to maintain an overall planar configuration for holding items. Such a moveable latch 205 may be implemented in combination with the aforementioned spring, or instead of the utilization of the spring. The parts of the shelf 200 labeled as 201, 202, 203, 204, 206, 207, and 208 may be similarly configured as the corresponding parts 101, 102, 103, 104, 106, 107, and 108 of the shelf 100.

FIG. 2A shows the moveable latch 205 in a locked position whereby the first and second planar members 201, 202 are sufficiently "locked" into a substantially coplanar arrangement. As can be seen in FIG. 2A, the moveable latch 205 can be configured so that the planar members 201, 202 are "locked" into an arrangement in which the first and second planar members 201, 202 are nearly coplanar. FIG. 2B shows the moveable latch 205 in an open position (moving the latch 205 between the locked and open positions can be performed manually) so that the first and second planar members 201, 202 can pivot at angles respective to each other (i.e., so that the first and second planar members 201, 202 are not substantially coplanar with each other) about the hinge mechanism 203.

Figure 3:
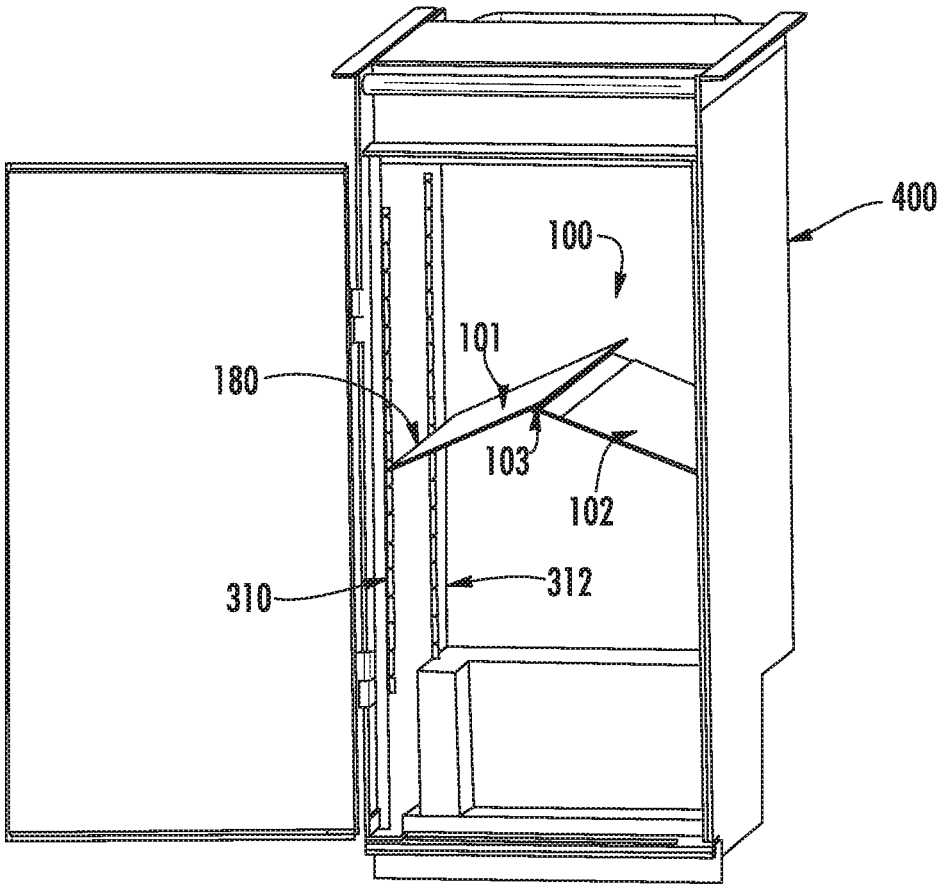
FIG. 3 illustrates an exemplary positioning of a shelf into a storage apparatus, in accordance with embodiments of the present disclosure.
Figure 4B:
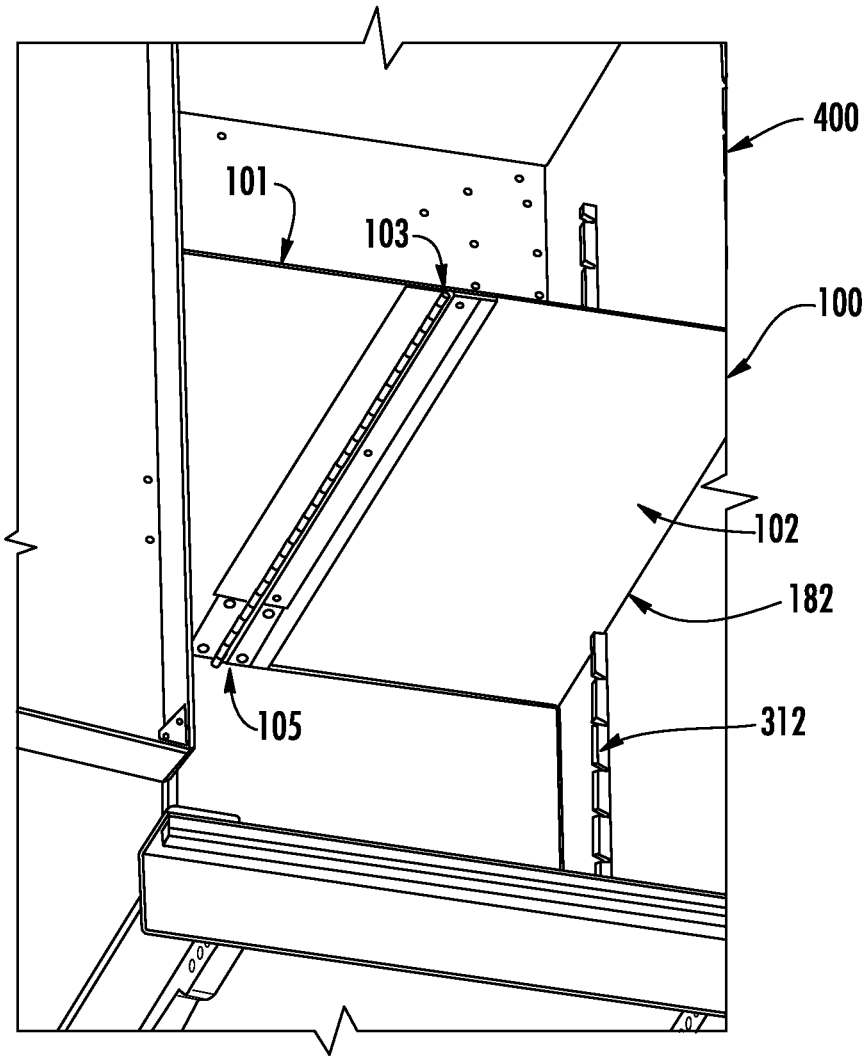
FIG. 4B illustrates a view of the shelf of FIG. 4A from the underside.

FIGS. 3, 4A, and 4B will be described with respect to the shelf 100. However, the shelf 200 could alternatively be used in a like manner.

FIG. 3 illustrates a positioning of the shelf 100 at one of a plurality of locations in an exemplary storage apparatus 400. The exemplary storage apparatus 400 may be a storage box such as disclosed within the U.S. published patent application no. 2016/0244079, which is hereby incorporated by reference herein. The storage apparatus 400 may have pairs of notches 310, 312 in two separate columns on each of the insides of the walls of the storage apparatus 400 for holding the shelf 100 at various locations (e.g., heights) within the storage apparatus 400 (because of the nature of the illustration in FIG. 3, the pairs of notches on the right inside wall of the storage apparatus 400 are not shown). If a user desires to insert the shelf 100 into the storage apparatus 400, or reposition the shelf 100 from one of the heights to another, the user may push upward on the relative center of an underside of the shelf 100 so that the first and second planar members 101, 102 pivot about the hinge mechanism 103 at an angle (e.g., other than 180°) relative to each other so that the distal ends 180, 181 of the shelf 100 are sufficiently withdrawn from the notches. The shelf 100 can then be removed from the storage apparatus 400 or placed at another desired location (e.g., height) within the storage apparatus 400, and the first and second planar members 101, 102 are then pivoted relative to each other back to a configuration whereby they are substantially planar to each other (e.g., an angle of 180°, which results in an insertion of the distal ends 180, 181 of the shelf 100 into a new set of corresponding pairs of notches. The shelf 100 is now in a usable configuration ready to receive items thereon (see FIGS. 4A-4B). Note that if the spring 105 is implemented in the shelf 100, then the spring 105 will assist in pivoting the first and second planar members 101, 102 back to a configuration whereby they are substantially planar to each other. Note that within embodiments of the present disclosure, the spring 105 may be configured with a sufficient tension to maintain the distal ends 180, 181 of the first and second planar members in engagement with the notches on each of the walls of the storage apparatus.

Note that the embodiments of the present disclosure are not limited to holding the shelf 100 with pairs of notches formed on insides of the walls of the storage apparatus 400. The pairs of notches (e.g., notches 310, 312) may be replaced with any number N of such notches, where N≥1. Furthermore, such notches may be formed into one or more rails attached to the insides of the walls of the storage apparatus. Yet still further, the shelf 100 may be held in a location within the storage apparatus 400 by one or more pins or pegs inserted into the walls, or ledges attached to or formed in the insides of the walls. Within embodiments of the present disclosure, any means for holding the shelf 100 at one of the various plurality of locations between the walls of the storage apparatus 400 may be utilized. Moreover, the shelf 100 may be utilized between any two walls, such as within a typical bookshelf or cabinet, wherein the two walls may be substantially parallel to each other.

FIG. 4A illustrates the shelf 100 in such a usable configuration whereby the first and second planar members 101, 102 are substantially planar to each other, and the distal ends 180, 181 of the shelf are inserted into the notches one each side, or wall, of the storage apparatus 400 so that items can now be placed onto the shelf 100. FIG. 4B illustrates a view of the shelf 100 of FIG. 4A from the underside.

As previously disclosed with respect to FIGS. 1A-1B, the spring 105 may be implemented with the shelf 100 to assist in maintaining the first and second planar members 101, 102 in a substantial planar configuration with each other. And, as previously discussed with respect to FIGS. 2A-2B, a moveable latch 205 may be utilized instead of the spring 105, or in combination with the spring 105, to maintain the first and second planar members 101, 102 in a substantial planar configuration with each other. Such a spring 105 and/or moveable latch 205 may be advantageously utilized to keep the shelf 100, 200 positioned at the desired location in such situations where the storage apparatus (e.g., 400) is in a moveable or portable container, including within an airplane, boat, submarine, etc. In other words, such a spring 105 and/or moveable latch 205 may be configured to maintain the distal ends 180, 181 of the first and second planar members 101, 102 engaged within the notches on each of the walls at the selected location within the storage apparatus 400.

While these exemplary embodiments are described in sufficient detail to enable those skilled in the art to practice the invention, it should be understood that other embodiments may be realized and that various changes to the invention may be made without departing from the spirit and scope of the present invention. Thus, the foregoing more detailed description is not intended to limit the scope of the invention, as claimed, but is presented for purposes of illustration only to describe the features and characteristics of the present invention, and to sufficiently enable one skilled in the art to practice the invention. Accordingly, the scope of the present invention is to be defined solely by the appended claims.

In describing and claiming the present invention, the following terminology will be used.

The singular forms "a," "an," and "the" include plural referents unless the context clearly dictates otherwise.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a defacto equivalent of any other member of the same list solely based on their presentation in a common group without indications to the contrary.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

All publications and patent applications are herein incorporated by reference to the same extent as if each individual publication or patent application was specifically and individually indicated to be incorporated by reference.

What is claimed is:

1. A storage apparatus comprising:

a shelf having first and second planar members hingeably coupled to each other by a hinge mechanism; and first and second walls spaced apart from each other, wherein each of the first and second walls have a means for holding the shelf at a location between the first and second walls, wherein the shelf is configured so that the first and second planar members are pivotable at angles relative to each other about the hinge mechanism for insertion into and removing from the location between the first and second walls, wherein the means for holding the shelf at the location between the first and second walls is configured so that the shelf is positioned at the location substantially perpendicular to the first and second walls, and wherein each of the first and second walls include another means for holding the shelf at another location between the first and second walls, wherein the shelf is configured so that the first and second planar members are pivotable with respect to each other so that distal ends of the first and second planar members disengage with the means for holding the shelf at the location and the shelf is thus configured so it can be moved to the another location.

2. The storage apparatus as recited in claim 1, wherein the first wall is substantially parallel to the second wall, wherein the hinge mechanism is configured to be positioned relatively parallel to the first and second walls when the shelf is positioned at the location between the first and second walls.

3. A storage apparatus comprising:

a shelf having first and second planar members hingeably coupled to each other by a hinge mechanism; and first and second walls spaced apart from each other, wherein each of the first and second walls have a means for holding the shelf at a location between the first and second walls, wherein the shelf is configured so that the first and second planar members are pivotable at angles relative to each other about the hinge mechanism for insertion into and removing from the location between the first and second walls, wherein the means for holding the shelf at the location comprises one or more notches formed in the first and second walls, wherein the shelf is configured so that distal ends of the first and second planar members are withdrawn from the notches when the first and second planar members are manually pivoted at acute angles relative to each other.

4. The storage apparatus as recited in claim 1, wherein the means for holding the shelf at the location comprises one or more notches formed in one or more rails attached to insides of the first and second walls.

5. The storage apparatus as recited in claim 1, wherein the means for holding the shelf at the location comprises one or more pins inserted into the first and second walls.

6. A storage apparatus comprising:

a shelf having first and second planar members hingeably coupled to each other by a hinge mechanism; and first and second walls spaced apart from each other, wherein each of the first and second walls have a means for holding the shelf at a location between the first and second walls, wherein the shelf is configured so that the first and second planar members are pivotable at angles relative to each other about the hinge mechanism for insertion into and removing from the location between the first and second walls, wherein the shelf is configured so that the first and second planar members are substantially coplanar with each other when the shelf is positioned between the first and second walls, and wherein the shelf is configured so that the first and second planar members are pivotable to not be substantially coplanar with each other while the shelf is inserted into or removed from the location.

7. The storage apparatus as recited in claim 6, wherein the second planar member is configured so that a first portion of the first planar member is positioned over and adjacent to a second portion of the second planar member when the shelf is positioned at the location between the first and second walls, wherein the shelf is configured so that the second portion of the second planar member supports the first portion of the first planar member when the shelf is positioned at the location between the first and second walls, wherein the first and second walls are each substantially perpendicular to the shelf when the shelf is positioned at the location between the first and second walls, wherein the first and second walls are substantially parallel to each other.

8. The storage apparatus as recited in claim 6, wherein the second planar member is configured so that a first portion of the first planar member is positioned over and adjacent to a second portion of the second planar member when the shelf is positioned at the location between the first and second walls, wherein the shelf is configured so that the second portion of the second planar member supports the first portion of the first planar member when the shelf is positioned at the location between the first and second walls, wherein the hinge mechanism is attached to a first edge of the second portion of the second planar member, and wherein the hinge mechanism is attached to the first planar member at a distance away from a second edge of the first planar member, wherein the first portion of the first planar member is located between the second edge of the first planar member.

9. The storage apparatus as recited in claim 8, wherein a top surface of the second portion of the second planar member is parallel to but not coplanar with a remaining top surface of the second planar member, wherein the shelf is configured so that a top surface of the first planar member is substantially coplanar with the remaining top surface of the second planar member when the shelf is positioned at the location between the first and second walls.

10. The storage apparatus as recited in claim 8, wherein the shelf is configured so that the distal ends of the first and second planar members are maintained in engagement with one or more notches positioned along each of the first and second walls.

11. The storage apparatus as recited in claim 8, wherein the shelf further includes a moveable latch configured to (1) permit the first and second planar members to pivot relative to each other about the hinge mechanism so as to not be parallel to each other when the moveable latch is in an open position, and (2) prevent the first and second planar members to pivot relative to each other from a substantially coplanar arrangement when the moveable latch is in a locked position.

12. The storage apparatus as recited in claim 6, wherein the shelf further includes a spring configured with a sufficient spring tension to maintain top surfaces of the first and second planar members in a coplanar arrangement relative to each other.

13. An adjustable shelf comprising:

first and second planar members; and a hinge mechanism coupling the first and second planar member in a configuration that permits the first and second planar members of the adjustable shelf to pivot relative to each other about the hinge mechanism, wherein the hinge mechanism is adjoined to a first edge of the second portion of the second planar member, and wherein the hinge mechanism is adjoined to the first planar member at a distance away from a second edge of the first planar member, wherein the first portion of the first planar member is located between the second edge of the first planar member, wherein the shelf further includes a spring configured with a sufficient spring tension to maintain the first and second planar members in a substantially coplanar arrangement relative to each other.

14. The adjustable shelf as recited in claim 13, wherein a top surface of the second portion of the second planar member is parallel to but not coplanar with a remaining top surface of the second planar member, wherein the shelf is configured so that a top surface of the first planar member is substantially coplanar with the remaining top surface of the second planar member when the adjustable shelf is configured so that the first and second planar members are substantially coplanar, wherein the spring is wound around a portion of a pin in the hinge mechanism.

15. The adjustable shelf as recited in claim 13, wherein the shelf further comprises a means to lock the first and second planar members in a substantially parallel arrangement relative to each other.

16. The adjustable shelf as recited in claim 13, wherein the shelf further includes a moveable latch configured (1) with an open position that permits the first and second planar members to pivot relative to each other about the hinge mechanism so as to not be parallel to each other, and (2) a locked position that prevents the first and second planar members from pivoting relative to each other from a substantially coplanar arrangement, wherein the moveable latch is in slideable engagement with a bracket affixed to an underneath surface of the first planar member; wherein the moveable latch comprises a rigid bar, and wherein the slideable engagement is configured so that the rigid bar is positioned underneath portions of both of the first and second planar members on both sides of the hinged mechanism when the moveable latch is in the locked position, and wherein the slideable engagement is configured so that the rigid bar is positioned underneath the first planar member and not underneath the second planar member when the moveable latch is in the open position.

17. The storage apparatus as recited in claim 11, wherein the moveable latch is in slideable engagement with a bracket affixed to an underneath surface of the first planar member.

18. The storage apparatus as recited in claim 17, wherein the moveable latch comprises a rigid bar, and wherein the slideable engagement is configured so that the rigid bar is positioned underneath portions of both of the first and second planar members on both sides of the hinged mechanism when the moveable latch is in the locked position, and wherein the slideable engagement is configured so that the rigid bar is positioned underneath the first planar member and not underneath the second planar member when the moveable latch is in the open position.

19. The storage apparatus as recited in claim 1, wherein the shelf is configured to be moved to the another location within the storage apparatus subsequent to the storage apparatus being in an assembled state.

20. A storage apparatus comprising:

a shelf having first and second planar members hingeably coupled to each other by a hinge mechanism; and first and second walls spaced apart from each other, wherein each of the first and second walls have a means for holding the shelf at a location between the first and second walls, wherein the shelf is configured so that the first and second planar members are pivotable at angles relative to each other about the hinge mechanism for insertion into and removing from the location between the first and second walls, wherein the shelf further includes a moveable latch configured to (1) permit the first and second planar members to pivot relative to each other about the hinge mechanism so as to not be parallel to each other when the moveable latch is in an open position, and (2) prevent the first and second planar members to pivot relative to each other from a substantially coplanar arrangement when the moveable latch is in a locked position, wherein the moveable latch is in slideable engagement with a bracket affixed to an underneath surface of the first planar member.

* * * * *